US010450184B2

(12) United States Patent
Gerdes

(10) Patent No.: US 10,450,184 B2
(45) Date of Patent: Oct. 22, 2019

(54) BRIDLE FOR A RIDING ANIMAL, PARTICULARLY FOR A RIDING HORSE

(71) Applicant: Gerd Gerdes, Garrel (DE)

(72) Inventor: Gerd Gerdes, Garrel (DE)

( * ) Notice: Subject to any disclaimer, the term of this patent is extended or adjusted under 35 U.S.C. 154(b) by 225 days.

(21) Appl. No.: 15/074,868

(22) Filed: Mar. 18, 2016

(65) Prior Publication Data

US 2016/0272479 A1 Sep. 22, 2016

(30) Foreign Application Priority Data

Mar. 20, 2015 (TW) ..... 10 2015 003 706

(51) Int. Cl.
*B68B 1/04* (2006.01)
*B68C 1/14* (2006.01)

(52) U.S. Cl.
CPC . *B68B 1/04* (2013.01); *B68C 1/14* (2013.01)

(58) Field of Classification Search
CPC .... B68B 1/04; B68B 1/14; B68B 5/00; B68B 5/06; B68B 99/00
USPC ..... 54/71, 6.1, 35, 23; 119/865; 292/262, 292/271, 342; 403/83, 84, 119, 161, 163, 403/167, 168, 326, 329, 345, 355
See application file for complete search history.

(56) References Cited

U.S. PATENT DOCUMENTS 1,548,023 A * 8/1925 Cowell ..... B68B 5/00 24/371
3,131,674 A * 5/1964 Dalton ..... A01K 27/005 119/865
3,144,741 A * 8/1964 Andersson ..... B62C 5/02 278/29
4,376,366 A * 3/1983 Miller ..... B68B 1/02 119/865
4,536,925 A * 8/1985 Boothe ..... A45F 5/02 16/222
5,161,351 A * 11/1992 Woodruff ..... A44B 11/14 24/170
5,595,396 A * 1/1997 Bourdeau ..... A43B 5/0401 280/607
5,771,843 A * 6/1998 Karlin ..... A01K 1/06 119/772

(Continued)

FOREIGN PATENT DOCUMENTS

DE 10 2006 051 407 A1 5/2008
DE 10 2007 034 068 A1 2/2009

(Continued)

OTHER PUBLICATIONS

English-language translation of DE 202012104755.*

*Primary Examiner* — Lisa L Tsang
(74) *Attorney, Agent, or Firm* — Muncy, Geissler, Olds & Lowe, P.C.

(57) ABSTRACT

A bridle for a riding animal, particularly for a riding horse, includes at least one martingale, which is guided below the neck of the riding animal and is fastened on a girth. The fastening of the martingale takes place by way, of at least one pull-latch lock, which includes a lock body fixedly arranged on the girth and a tie rod, which can be removed from the same by way of the action of a transverse force and is in operative connection with the martingale. Falls due to the entanglement preferably of forelegs and martingales of the bridle can be prevented when using this bridle.

5 Claims, 3 Drawing Sheets

(56) References Cited

U.S. PATENT DOCUMENTS 5,927,895 A * 7/1999 Watanabe ..... F16B 45/02
24/669

FOREIGN PATENT DOCUMENTS

DE 20 2012 104 755 U1 3/2013
FR 2596744 A1 * 10/1987 ..... B68B 1/04

* cited by examiner

BRIDLE FOR A RIDING ANIMAL, PARTICULARLY FOR A RIDING HORSE

BACKGROUND OF THE INVENTION

Field of the Invention

The invention relates to a bridle for a riding animal, particularly for a riding horse, comprising at least one martingale, which is also guided below the neck of the riding animal and is fastened on a girth.

Description of Related Art

Riding animals that differ from one another are used by humans and a bridle is regularly used in the process. The bridle comprises a halter for the head of the riding animal, reins for guiding the same and also a saddle for sitting a rider on the riding animal. Riding horses are equipped with saddles for women and men and martingales are also used, in addition to the halter, reins and saddle. These martingales run below the neck of the riding animal and are fastened on the girth, for example.

Martingales of this type can cooperate with the main reins of the rider. They are possibly also used for holding down the head of the riding animal. It is problematic if a riding animal steps into one such martingale with its foreleg or one of its forelegs is entangled in one such martingale. It is not then possible for the riding animal to put the foreleg back on the ground and painful falls are the consequence.

The invention is therefore based on the object of developing a bridle for a riding animal of the type mentioned at the beginning in such a manner that serious falls due to the entanglement of forelegs in martingales of the bridle are prevented.

This object is achieved according to the invention in that the fastening of the martingale takes place by means of at least one pull-latch lock, which comprises a lock body fixedly arranged on the girth and a tie rod, which can be removed from the same by means of the action of a transverse force and is in operative connection with the martingale.

In the bridle according to the invention, the martingale is fastened on the girth, as in the prior art. However, the fastening does not take place in a fixed manner, but rather only in a manner resistant to pulling. In the event of the action of a transverse force, by contrast, the fastening of the martingale on the girth can be overcome.

For example, if a foreleg of the riding animal becomes entangled in the martingale and the foreleg of the riding animal furthermore exerts a transverse force on the martingale, then this can detach the same from the girth and free the foreleg of the riding animal again. The pull-latch lock is provided to this end. This normally holds the tie rod, by means of which the martingale is fastened on the pull-latch lock. The martingale carries the tie rod, whilst the lock body is fastened on the girth. If both components are only loaded by pulling, the pull-latch lock holds. However, if a transverse force arises, the tie rod is removed from the lock body and the pull-latch lock is opened.

BRIEF SUMMARY OF THE INVENTION

According to a first development of the invention, it is provided that the lock body has an undercut for a section of the tie rod. The section of the tie rod can be introduced into the undercut and as a result, the pull-latch lock is closed and can be loaded by pulling. Normal pulling is not capable of pulling the section of the tie rod located in the undercut out of the same.

According to a next development, it is therefore provided that a spring-loaded hold-down device for the tie rod is assigned to the undercut of the lock body. This hold-down device holds the section of the tie rod in the undercut and prevents it from coming out under normal longitudinal pulling forces. The hold-down device has a tongue design for example, which protrudes a little beyond the tie rod introduced into the undercut. The section of the tie rod introduced into the undercut is preferably constructed as a projection in this case. An elastic component can also be provided for the hold-down device, for example a belt made from rubber or leather.

Due to the spring loading of the hold-down device, the hold-down device can be lifted if a transverse force acts on the tie rod. In this case, the hold-down device releases the undercut of the lock body to the extent that the projection of the tie rod located in the undercut is pulled out of the same. The pull-latch lock is opened.

After an opening of the pull-latch lock, the same can be closed again. The components of the pull-latch lock are therefore reusable. They are preferably manufactured from metal so that they have the required robustness.

BRIEF DESCRIPTION OF THE SEVERAL VIEWS OF THE DRAWINGS

An exemplary embodiment of the invention, from which further features of the invention arise, is illustrated in the drawing. In the figures.

DETAILED DESCRIPTION OF THE INVENTION

Figure 1:
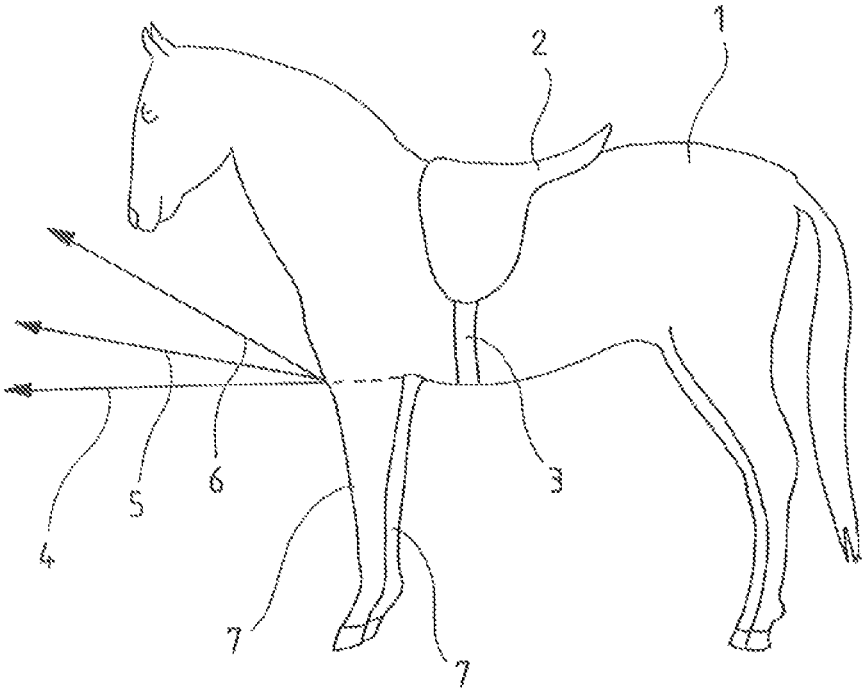
FIG. 1: shows a side view of a riding horse with the bridle according to the invention.

The riding animal shown in FIG. 1 is a horse 1. The horse 1 carries a riding saddle 2 on the bridle illustrated, to which saddle a girth 3 is assigned. The girth 3 is guided under the abdomen of the horse 1.

Martingales are indicated with the arrows 4, 5, 6. These can be used for example for guiding the horse 1. Each martingale is connected to the girth 3 by means of a pull-latch lock attached on the girth 3.

The pull-latch lock is not shown in FIG. 1, but it should open if one of the forelegs 7 of the riding horse 1 steps into one of the martingales indicated by the arrows 4, 5, 6. In this case, a martingale is deflected downwards and a transverse force occurs. This transverse force is indicated in FIG. 3 with the arrow 8.

Figure 2:
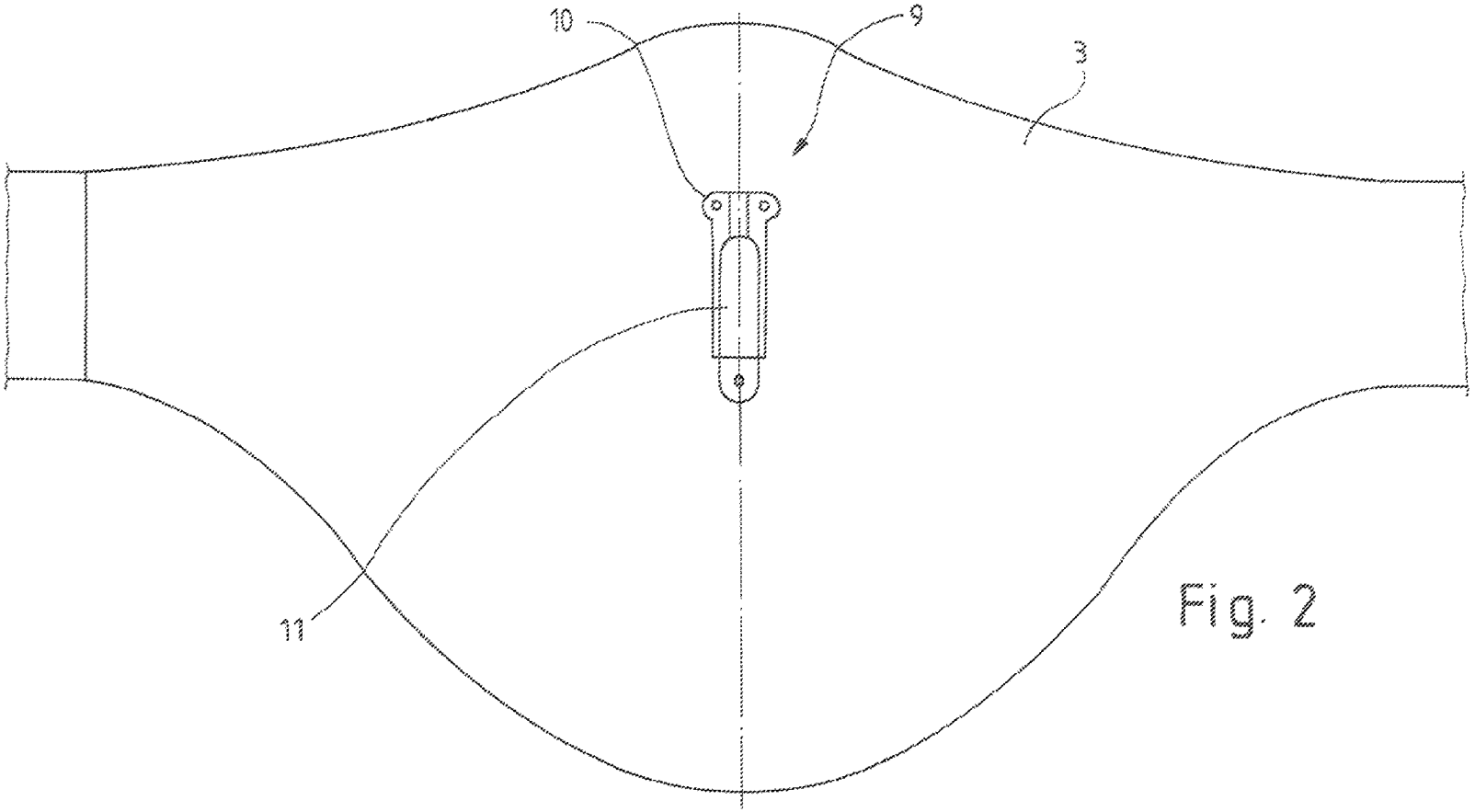
FIG. 2: shows a side view of a component of the bridle according to FIG. 1, FIG. 3: shows a side view of a detail of the bridle according to FIG. 2 on an enlarged scale.

FIG. 2 shows the girth 3. This widens in the abdomen bearing region of the horse 1 and carries the pull-latch lock 9 in this region. Martingales are not shown in FIG. 2 and FIG. 3.

The pull-latch lock 9 comprises a lock body 10 fixedly arranged on the girth 3. A tie rod, which is not shown in FIG. 2, can come into operative connection with this lock body 10 and the tie rod 13 is connected to the martingale in this case. FIG. 2 shows that a hold-down device 11 is assigned to the lock body 10. The hold-down device 11 has a tongue design and is also fixedly fastened on the girth 3.

Figure 3:
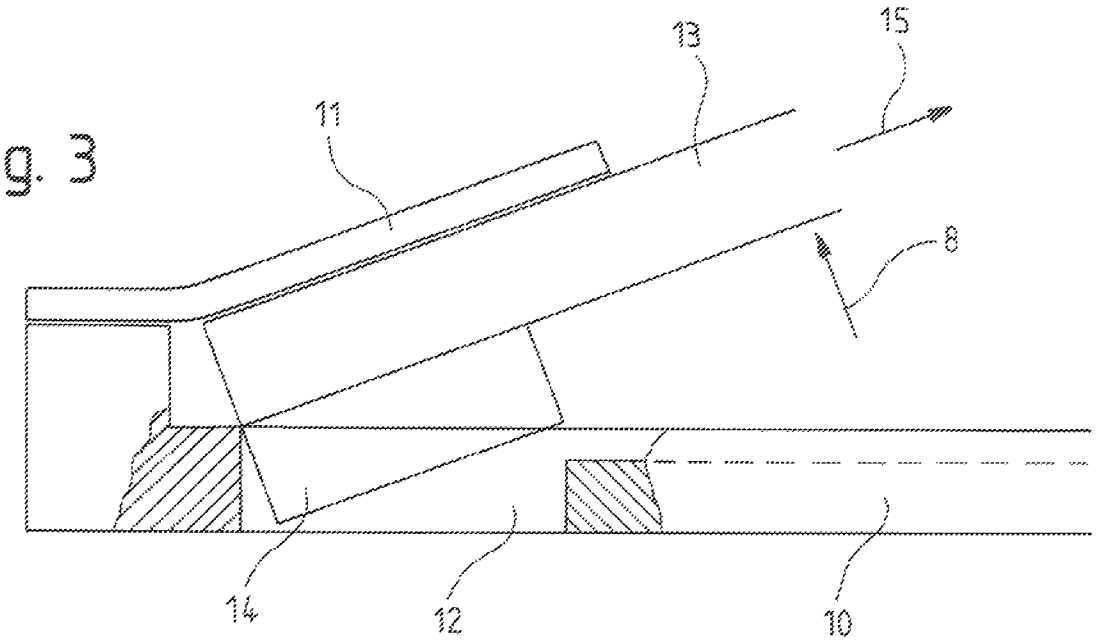

The lock body 10 is arranged bottommost in FIG. 3. It has an undercut 12, which is constructed as a depression. The tie rod 13 can protrude into this undercut 12 by way of a projection 14. Normally, in the case of pulling forces only occurring along arrow 15, the hold-down device 11 pushes the projection 14 down into the undercut 12. However, a transverse force along arrow 8 occurs in FIG. 3 and this lifts the tie rod 13 out and therefore detaches the martingale from the girth 3.

All of the features mentioned in the preceding description and in the claims can be combined in any desired selection with the features of the independent claim. The disclosure of the invention is therefore not limited to the described or claimed feature combinations, rather all sensible feature combinations in the context of the invention are to be considered as disclosed.

The invention claimed is:

1. A bridle for a riding animal, comprising:

a girth; and at least one martingale guided below a neck of the riding animal and connected to the girth, wherein the martingale is fastened by at least one pull-latch lock, the at least one pull-latch lock comprising:

a lock body fixedly mounted on the girth; and a tie rod, to which the at least one martingale is operatively connected, wherein the tie rod is configured to be removed from the lock body only by a transverse force exerted on the at least one martingale, wherein a sole pulling force exerted along a plane of the at least one martingale keeps the tie rod connected to the lock body.

2. The bridle according to claim 1, wherein the lock body has an undercut for a section of the tie rod.

3. The bridle according to claim 2, wherein the tie rod has a projection which can protrude into the undercut.

4. The bridle according to claim 3, wherein the at least one pull-latch lock comprises a spring-loaded hold-down device fastened to the girth and configured to push the protruding projection of the tie rod inside the undercut of the lock body.

5. The bridle according to claim 1, wherein the at least one pull-latch lock is manufactured from metal.

* * * * *